United States Patent [19]

Cornely et al.

[11] Patent Number: 4,652,174

[45] Date of Patent: Mar. 24, 1987

[54] METHOD OF FORMING UNDERGROUND DUCTS, CONDUITS AND THE LIKE

[75] Inventors: Wolfgang Cornely, Gladbeck; Dietrich Stein, Bochum; Bernhard Maidl, Bochum; Karl Kubicki, Bochum, all of Fed. Rep. of Germany

[73] Assignee: Bergwerksverband GmbH, Essen, Fed. Rep. of Germany

[21] Appl. No.: 697,739

[22] Filed: Feb. 4, 1985

[30] Foreign Application Priority Data

Feb. 7, 1984 [DE] Fed. Rep. of Germany ..... 3404111

[51] Int. Cl.[4] ..... E02D 29/10; E21D 11/00

[52] U.S. Cl. ..... 405/146; 405/150; 405/155; 264/33

[58] Field of Search ..... 405/138, 146, 150, 154, 405/156, 157, 184, 132, 134, 258; 175/62; 264/31–33, 45.3, 34; 425/59; 249/11

[56] References Cited

U.S. PATENT DOCUMENTS

| | | | |
|---|---|---|---|
| 3,349,568 | 10/1967 | Smith et al. | 405/155 |
| 3,379,024 | 4/1968 | Wohlmeyer | 405/146 |
| 3,827,244 | 8/1974 | Walbröhl | 405/150 X |
| 4,164,526 | 8/1979 | Clay et al. | 264/45.3 |
| 4,237,182 | 12/1980 | Fulmer et al. | 405/150 X |
| 4,398,845 | 8/1983 | Stuckmann et al. | 405/138 X |
| 4,451,176 | 5/1984 | Flocke et al. | 405/146 |
| 4,461,850 | 7/1984 | Carignani et al. | 264/45.3 X |
| 4,542,054 | 9/1985 | Fillmann | 264/45.3 X |

FOREIGN PATENT DOCUMENTS

| | | | |
|---|---|---|---|
| 774835 | 1/1968 | Canada | 405/146 |
| 2837333 | 3/1980 | Fed. Rep. of Germany | 405/132 |
| 1018937 | 2/1966 | United Kingdom | 405/155 |

*Primary Examiner*—Cornelius J. Husar
*Assistant Examiner*—Nancy J. Stodola
*Attorney, Agent, or Firm*—Karl F. Ross; Herbert Dubno

[57] ABSTRACT

The manufacture of extended, inaccessible holes for underground ducts, conduits and the like is performed by a closed construction process, wherein the preferably remotely-controlled excavation is performed and following that a structure is installed which is employed as the product duct, conduit or the like. The installed structure is provided by injection of an injection material under pressure into an annular space between a form following the excavating apparatus and the ground to manufacture at least one endless inner wall for the hole which then serves as the underground duct, conduit or the like. The novel apparatus of this invention correspondingly comprises a form following the required excavation mechanism conformed to form an annular space between the form and the ground, that form having a form front closing the form and at least one inlet therein for injection of an injection material into the annular space.

8 Claims, 3 Drawing Figures

4b
4a
4

4
14
3

6
5
7
FORM SHELL
4
9
8
11
2
3d
3
3a
3b
CUTTING HEAD DRIVE
DIRIGIBLE CUTTING HEAD
10
20
21
P
P
22
COMPONENT 1
SOLID FILLER
COMPONENT 2
3c
HEAD CONTROLLER

METHOD OF FORMING UNDERGROUND DUCTS, CONDUITS AND THE LIKE

FIELD OF THE INVENTION

Our present invention relates to a method of forming relatively small section, nonaccessible, passages for underground ducts, conduits and the like, wherein the excavation is performed by, for example, a remotely-controlled excavating apparatus and in the subterranean structure a lining is provided that can be used as a product duct, conduit or pipe.

BACKGROUND OF THE INVENTION

It has been common in the prior art to construct underground supply and transport conduits or ducts which are not passable to a person i.e. not manually accessible, by open construction methods, that is, a ditch is dug, the pipe, duct or conduit is assembled in the ditch, and subsequently the ditch is filled.

Because the need for subterranean conduits is continuously increasing in built up areas these open construction methods, particularly in city environments, completely or partly block many city streets because of the excavations necessary for the conduits, pipes or ducts, for weeks on end. Because of this inconvenience it is desirable to resort to an underground or closed construction method.

In this kind of construction a shaft is formed and the subterranean passage is produced laterally from this shaft toward a target shaft by an excavating head with a conveyor screw or with means for flushing away the detritus for example to a maximum length of 80 meters. The product pipe often made of steel, is forced into this passage to form the liner.

The pressing operation whereby the liner is forced into the passage is a problem because of the long lengths and high resistance so that especially heavy machinery is required for this purpose. The wall thickness of the liner must also be comparatively great so as to accommodate such forces.

The essential disadvantages of this kind of process for laying product conduit or ducts in underground or closed construction methods, therefore, lie in the excavation length and the force gradient factors which limit the applications in which the technique may be used.

The development of processes and apparatus for excavating extended holes for underground ducts, conduits and the like has reached the point that today one can make use of controllable excavation processes, which are remotely-controlled. Dirigible cutting heads can be guided through subterranean structures with commercially available control equipment.

The major difficulty here is the lining of the extended hole with a fluid-impermeable structure or to provide this type of extended hole with a similar structure which can act as a duct, conduit or the like.

OBJECTS OF THE INVENTION

It is the principal object of our present invention to provide an improved process of making and lining underground passages for use as fluid conduits, ducts and the like.

It is also an object of this invention to provide an improved method of making lined underground passages which can be used as conduits, ducts and the like.

It is a further object of this invention to provide an improved method of forming subterranean passages which are generally inaccessible and without surface excavation in structures such as the ground and bedrock, which apparatus is capable of driving a greater excavation length in an economical way, and wherein the driving of both straight and curved pipelines is possible and simultaneously product pipes, ducts or conduits are capable of being produced free from the tendency toward corrosion.

Yet a further object of this invention is to provide a method of producing subterranean pipelines whereby the disadvantages outlined above are obviated.

SUMMARY OF THE INVENTION

These objects and others which will become apparent hereinafter are attained in accordance with the invention in a construction process for underground extended holes used for making pipelines, conduits and the like, comprising excavating a nonhumanly-passable extended passage in the ground, bedrock or the like using a preferably remotely-controlled excavating apparatus.

According to a preferred embodiment of our invention at least one endless (continuous) inner wall is formed in the underground hole by injection of a hardenable synthetic resin injection material into an annular space between a form arranged to follow the excavating apparatus and the solid body in which the hole is made, that is, the ground or the bedrock.

Thus the product pipeline, duct, or the like is formed physically a part of and united (bonded) with the extended, underground passage rather than, as was done in the prior art, by having a separate structure, that is, a pipe or conduit, forced through the passage.

Within the scope of this invention it has proved particularly advantageous to inject a foaming injection material, particularly a reactive plastic (synthetic resin) such as polyurethane and thereby form an inner wall and also to form additionally an outer wall constructed in union with the aforementioned inner wall by injection and foaming of the injected material under pressure in the ground or bedrock adjacent the annular space of the form.

In other words the injection pressure and that of the expansion of the foam can cooperate to drive the liquid flowable and nonhardened resin relatively deeply into the surrounding subterranean structure to penetrate the latter, stabilize loose material thereof, and provide an intimate bond with this structure.

With the help of the injection technique there will, where injection of the surrounding earth is possible, be a bonding between the inner and outer wall, also between the supported, solidified and/or sealed ground and the supported and/or impervious layer. These bonds produce a final product structure which is stronger and firmer than can be achieved with a prefabricated liner of similar material.

According to another feature of this invention it is possible during formation of the inner wall to provide additionally in the annular space nonbound loose stones, fibers or fillers and mixtures thereof. The introduction of this material into the annular space can take place between the form and the bordering ground before the injection of injection material but usually with the injection material. As filler material loose stone, stone powder, electrostatic filter ash, or similar materials may be used. As fiber material, steel fiber, plastic fiber, glass fiber or similar fiber can be employed.

According to the invention apparatus for carrying out the above novel process comprises essentially the following: that attached to the excavating apparatus and following it is a holohedral form which is supported at its rear end, opposite to the end attached to the excavating apparatus, on the solidified inner wall and which is conformed to provide an annular space between the form and the solid body, i.e. the ground or earth. The front side of the form is provided with a form front which closes the form and at least one inlet is provided for the injection material along the length of the form.

The form can be constructed as a sliding or transposing (reversing) or rotatable form.

According to a further embodiment of the invention it is possible to support the end of the form adjacent the excavating apparatus and/or by supporting cylinders.

The length of the form is determined by the speed of the excavation apparatus employed and the hardening properties of the injection material and is sufficient that the injected material will be at least mostly hardened and is fully self-supporting when the form or shield is withdrawn.

The technical advance of the invention is based significantly on a reduction of the burdens and loads on the apparatus forming the underground pipeline. This invention allows the manufacture of underground passages driven over greater lengths much more accurately and the installation in that passage of a structure satisfying the fluid-impermeability requirements for a pipeline, conduit, duct or the like.

BRIEF DESCRIPTION OF THE DRAWINGS

The above and other objects, features and advantages of our invention will become more readily apparent from the following description, reference being made to the accompanying highly diagrammatic drawing in which:

FIG. 1 is a schematic side, cross sectional view illustrating the novel process for forming underground passages for making pipelines, conduits and the like;

FIG. 2 is a fragmentary elevation of another embodiment; and

FIG. 3 is a detail of another feature in cross section.

SPECIFIC DESCRIPTION

Figures 1, 2, 3:
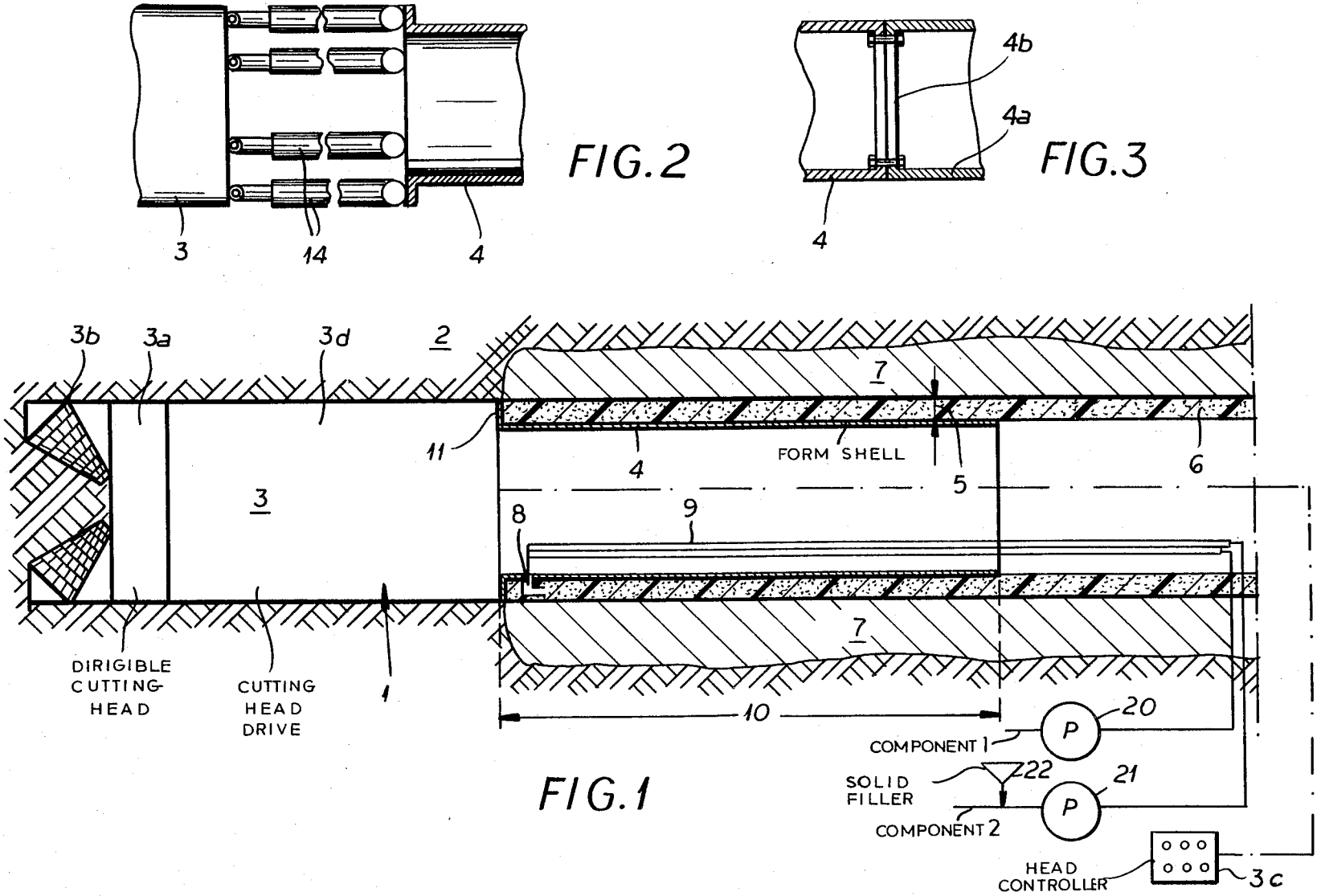

The end of an extended underground passage 1 under excavation according to this invention is illustrated in FIG. 1. This hole or shaft 1 is not passable to a standing or crawling person and is thus referred to as inaccessible and cannot be formed by an operator or worker present at the immediate excavation site. An excavating machine 3, for example, a remotely-controlled excavating machine with a cutting head 3*a* with cutters 3*b* whose direction of advance is controlled by panel 3*c*, and a drive 3*d* for the head, is shown in the passage 1 surrounded by rock or ground 2.

A sliding form 4 closed in the direction of the excavating machine 3 by outwardly extending form front 11 is provided following and adjacent to the excavating machine 3.

The sliding form 4 is supported in front in this preferred embodiment on the excavating machine drive 3*d* at the form front 11.

Alternatively the front of form 4 can be supported on the excavating machine 3 via cylinders 14 which are hydraulically extensible and retractable. The inner diameter of the sliding form 4 corresponds to the required normal inner dimension for the final product pipeline, duct, conduit or the like.

The form 4 is provided adjacent the excavation apparatus 3 with at least one inlet 8 for supply line 9, through which the injected compound or injection material will be forced in under pressure, for example pressure of up to 15 bar. The end of form 4 not adjacent excavating machine 3 is supported on the already hardened interior wall 6.

The length of the form 4 results from the adjustment of the speed of the excavating machine 3 and the hardening of the injection material. The injection pressure is chosen so that the annular space 5 of the form 4 will be completely filled and the ground 2 near the inner wall 6 will be penetrated by the foamed resin and hardened into outer wall 7 by the injected material. The outer wall 7 makes united structure possible between supporting, solidified or hardened, and/or sealed ground 2 and supported, impervious inner wall 6. The inner wall 6 forms the lining of the passage.

In the manufacture of the inner wall 6, as already mentioned, the injection material additionally can be filled with loose stones, fibers and/or other fillers.

As can be seen from FIG. 3, added sections 4*a* etc. can be connected to the form 4 by bolted flange joints 4*b* to vary the length of the form in accordance with the speed of the form to correlate the length with that required for the desired degree of hardening of the resin before the form withdraws from it.

The resin injected at 8 may be combined from two components forced into the space by respective pumps 20, 21 (e.g. a polyol and a polyisocyanate) and one of these components, at least, may be provided with a conventional polyurethane foaming agent. The solid or fiber fillers can be added to the resin by a hopper 22.

We claim:

1. A method of forming an underground conduit which comprises the steps of:

excavating an underground passage by guiding an excavating mechanism along a subterranean path by remote control of said mechanism;

shifting a form along the wall of said passage with said mechanism while defining an annular space between the form and the wall;

injecting a hardenable synthetic resin injection material under pressure into the annular space between said form following said excavating mechanism and said wall to form a fluid-impermeable lining consisting of said material for said passage; and injecting a foamable synthetic resin into permeable structure of said wall around said lining and thereby forming an outer wall by foaming of said foaming synthetic resin in said structure and uniting said outer wall to said lining.

2. The method defined in claim 1 wherein said resin of said lining and the resin of said outer wall is a polyurethane resin.

3. The method defined in claim 1 wherein said injection material is formed by mixing at least one filler with a resin.

4. The method defined in claim 3 wherein said filler is loose stone.

5. The method defined in claim 3 wherein said filler is stone powder.

6. The method defined in claim 3 wherein said filler is electrostatic filler ash.

7. The method defined in claim 3 wherein said filler is steel fiber.

8. The method defined in claim 3 wherein said filler is plastic fiber.

* * * * *